US005484368A

United States Patent [19]

Chang

[11] Patent Number: 5,484,368

[45] Date of Patent: Jan. 16, 1996

[54] MULTI-FUNCTION PULL BAR

[76] Inventor: Shao-Ying Chang, No. 764, Chung Shan South Road, Yang Mei, Taoyuan, Taiwan

[21] Appl. No.: 269,099

[22] Filed: Jun. 30, 1994

[51] Int. Cl.[6] ..... A63B 21/02

[52] U.S. Cl. ..... 482/122; 482/125; 482/126

[58] Field of Search ..... 482/121, 122, 482/124, 125, 120, 114, 115, 118, 126, 52

[56] References Cited

U.S. PATENT DOCUMENTS

| | | | |
|---|---|---|---|
| 3,893,667 | 7/1975 | Snyder, Jr. et al. | 482/123 |
| 4,290,600 | 9/1981 | Kölbel | 482/126 |
| 4,376,533 | 3/1983 | Kolbel | 482/125 |
| 4,961,573 | 10/1990 | Wehrell | 482/124 |
| 4,986,538 | 1/1991 | Ish, III | 482/138 |
| 5,154,684 | 10/1992 | Delf | 482/123 |
| 5,222,927 | 6/1993 | Chang | 482/126 |
| 5,348,520 | 9/1994 | Chang | 482/52 |

*Primary Examiner*—Lynne A. Reichard
*Attorney, Agent, or Firm*—Burns, Doane, Swecker & Mathis

[57] ABSTRACT

A multi-function pull bar for performing a variety of body exercises in chest-expanding and in developing strength in the arm, neck and legs, comprises a hollow main bar body having an extensible dual sleeve tube structure and an elastic cord pull device elastically stretchably located inside the main bar body and having the free ends of two pull cords leading out respectively from the two end housings of the main body. At each end of the main bar body is provided a housing, inside the housings are pulley assemblies for holding and guiding the two pull cords. The two pull cords of the cord pull device are connected at the free ends thereof respectively to a hook and between the two hooks is removably mounted a flexible grip belt or a rigid grip bar. On the main bar body may be attached a removably sleeve cover whereby it allows only the hook end of the pull cords to be exposed out.

6 Claims, 4 Drawing Sheets

FIG. 1
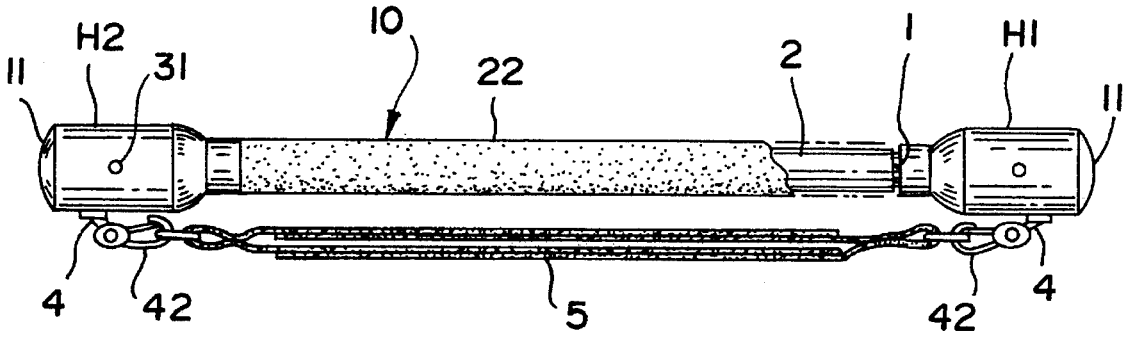
FIG. 4(A)
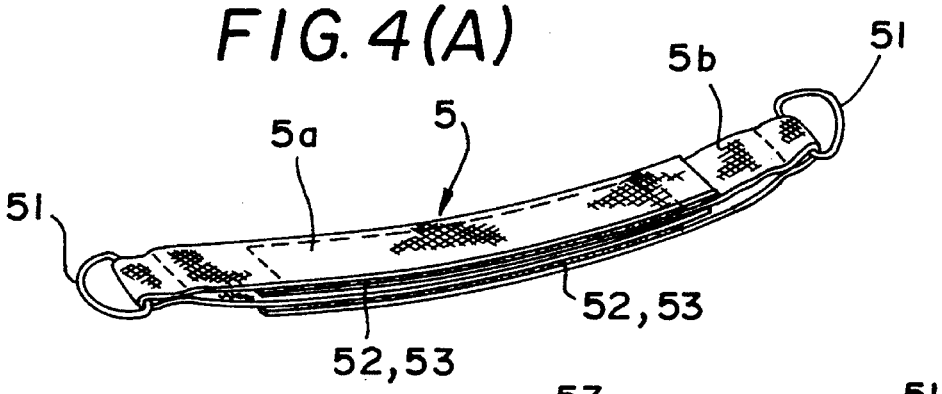
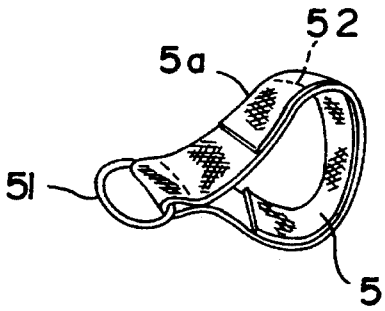
FIG. 4(B)
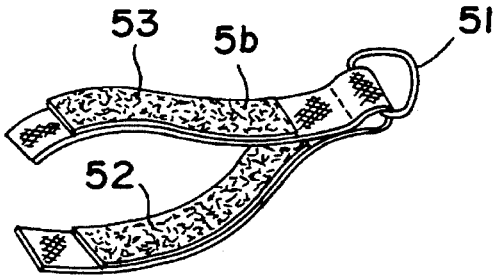
FIG. 4(C)

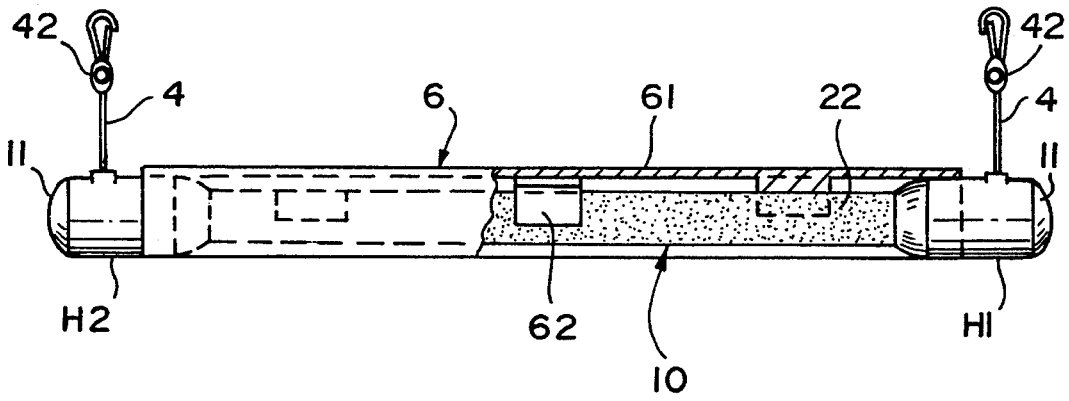
FIG. 5
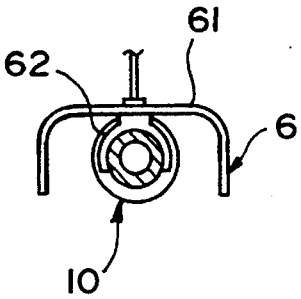
FIG. 6
FIG. 8(B)
PRIOR ART
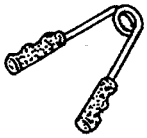
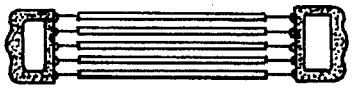
FIG. 8(A)
PRIOR ART
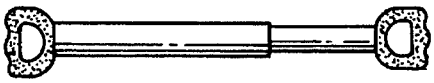
FIG. 8(C)
PRIOR ART
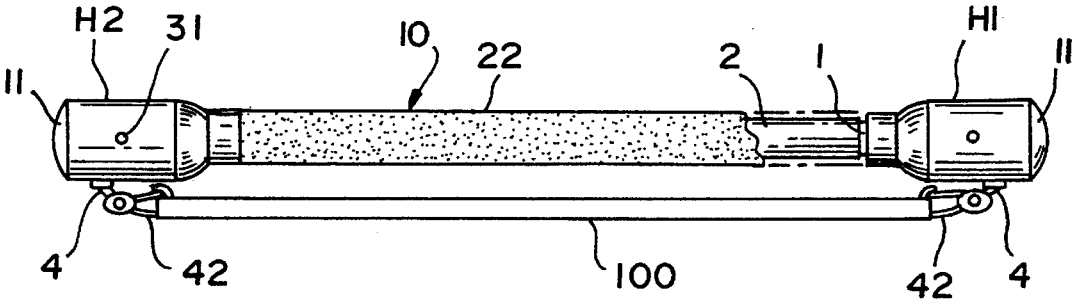
FIG. 9

MULTI-FUNCTION PULL BAR

BACKGROUND AND SUMMARY OF THE INVENTION

The present invention relates to a multi-function pull bar and particularly, to a simple and portable multi-function pull bar capable of providing for performing exercises in chest developing, arm strength, leg strength and body building.

Amongst the simple, portable type equipments for individual exercises to strengthen the body and develop gracefulness, there are already various kinds of chest expander and arm strength developer such as, for instance, appliances in FIGS. 8(A) through 8(C). These equipments, however, are useful only for doing a few kinds of exercise one upper half of the body as expanding and pulling of chese and developing strength of the wrist, and can not work on whole body exercise or perform a more variety of exercises. The equipments are limited in performance and in the two types of equipment as in FIGS. 8(A) and 8(B), because of the exposed springs skin and muscle easily get pressed and hurt on inadventency. Again, in the equipment of FIG. 8(C) because screw springs are mounted inside the tube, the equipment s able to perform the expanding and compressing actions only.

Accordingly, it is an object of the present invention to provide a multi-function pull bar having a stretchable extension cord concealed thereinside for developing and expanding in chest and for developing arm and leg strength and various parts of muscle.

It is a further object of the invention to provide a multi-function pull bar having an outer appearance like a round bar, which is convenient to carry with and keep and which cost of production is low.

It is yet another object of the invention to provide a multi-function pull bar with a removable grip belt, the grip belt having a variety of use.

It is yet an additional object of the invention to provide a multi-function pull bar capable of widening the range of use upon collaboration with a simple sleeve cover.

BRIEF DESCRIPTION OF THE DRAWINGS

The foregoing and other objects, and advantages of the invention will be apparent from the following description of the preferred embodiment, when taken in connection with the accompanying drawings wherein:

FIG. 1 is a front view of the external appearance of an embodiment of the multi-function pull bar of the present invention;

FIGS. 4(A)–(C) are perspective views of one embodiment of the grip belt used in the pull bar of the invention;

FIG. 5 is a partial longitudinal section front view of an example of the pull bar additionally equipped with a sleeve cover;

FIG. 6 is a partial longitudinal section lateral view of the pull bar shown in FIG. 5;

FIGS. 8(A)–(C) are front views of the conventional chest expanders.

FIG. 9 is a front view of another embodiment of the present invention.

DETAILED DESCRIPTION OF THE PREFERRED EMBODIMENT

Figure 2:
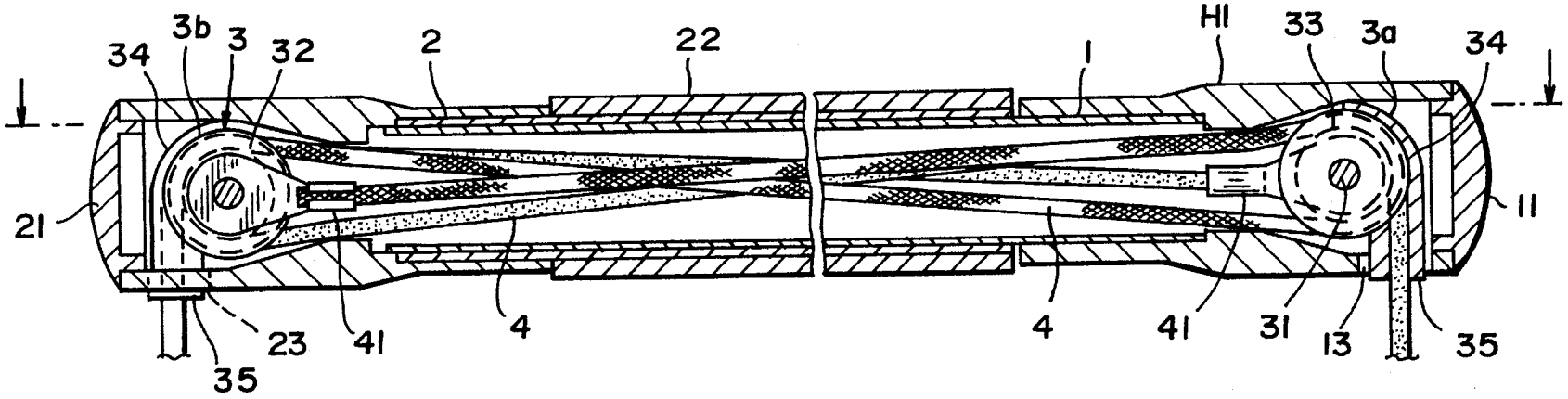
FIG. 2 is a partial middle longitudinal sectional view of the pull bar shown in FIG. 1.

Now, referring to FIG. 1, a multi-function pull bar of the present invention comprises: an inner tube 1 mounted at one end with an end housing H1, an outer tube 2 slidably inserted in the inner tube I and provided at one end with an end housing H2 corresponding to the end housing H1, an assembly of pulleys 3 (FIGS. 2 and 3) located respectively in the hollow interiors of the end housings H1, H2, a pair of extension pull cords 4, 4 symmetrically wound against the assembly of pulleys 3 and having each free ends pulled out respectively from the two end housings H1, H2 , and a grip belt 5 having the two ends releasably hooked on the two free ends of the pull cords 4, 4.

Figure 3:
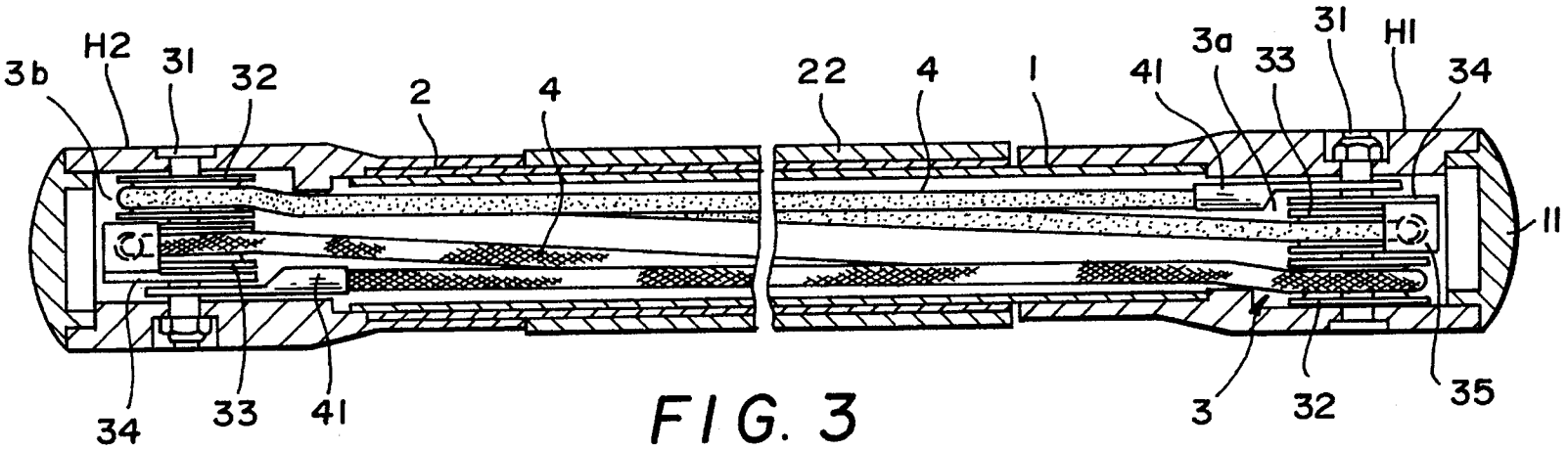
FIG. 3 is a partial sectional top view of the pull bar shown in FIG. 1.
Figure 7A:
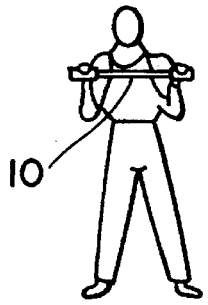
FIGS. 7(A)–(G) are schematic illustrations showing various use conditions of the pull bar of the invention.
Figure 7B:
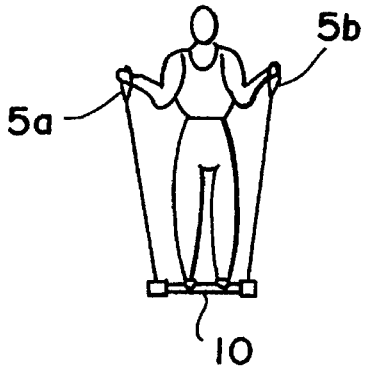
Figure 7C:
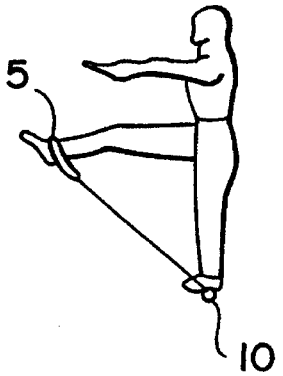
Figure 7D:
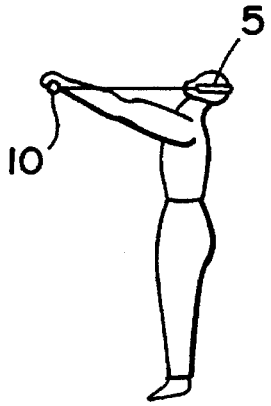
Figure 7E:
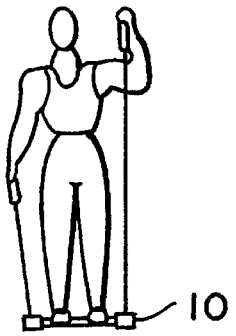
Figure 7F:
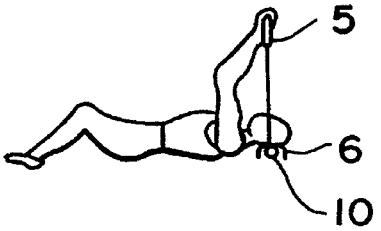
Figure 7G:
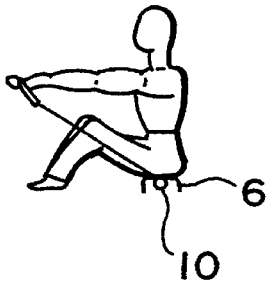

Referring next to FIGS. 2 and 3, the inner tube 1 is made of metallic pipe, for example, stainless steel tube. The inner tube 1 is fixed at one end by means of a screw or welding to a hollow end housing HI having a larger outer diameter, and in the interior of which is mounted an assembly of pulleys 3*a*, which will be described hereinafter, whereas the outer end opening of which is sealed with a plastic end cap 11. Next, the outer tube 2 is basically similar in construction and material to the inner tube 1, that is, on the one end of the metallic pipe 1 there is fixed an end housing H2 having in the interior mounted with the other assembly of pulleys 3b and the outer end opening sealed with an end cap 21. The difference lies only in that, the outer tube 2 has an inner diameter slightly larger than the outer diameter of the inner tube 1, whereby the outer tube is slidably fitted over the inner tube 1. The outer circumferential surface of the outer tube 2 is covered for example, with a foamed resin made soft sleeve 22 for the convenience of a grip.

The pulley assembly 3 consists essentially of two similar sets of pulleys 3*a* and 3*b* arranged respectively in the interiors of the end housings H1 and H2. Each set of pulleys 3*a* and 3*b* comprises a fixing shaft 31 radially passing through the gripping handle, at least two pulleys 32, 33 rotatably mounted on the shaft 31, and a pulley side cover 34 movably fitted to the shaft 31 closely adjacent a pulley, for example, the pulley 32 on the one side where there is a rope leading-out portion 35. On a lateral side at the same plane of the end housings H1, H2 and exactly opposite the location of the corresponding assembly of pulleys 3*a*, 3*b* there is formed respectively a pull cord outlet 13, 23. The cord leading-out portions 35 of the two pulley covers 34 are engaged appropriately in the pulley rope outlets 13, 23 and are capable of performing a restricted amount of axial movement inside these outlets. A pair of extensible,elastic pull cords 4, 4 having an equal length are each mounted by a by a connector 41 of one end on the pulley shaft 31 of each set of the pulley assemblies 3*a*, 3*b* for fixing and acting as the starting point while the other end which after passing through the interior of the inner tube 1 and winding around the pulley 33 of the opposite pulley assembly returns to, the starting point. The two cords after having passed around the respective pulleys 32 are pulled to the outside of the pull cord outlets 13, 23 of each end housings H1, H2 from the leading-out portions 35. On the terminal ends of the two cords are each connected with a spring hook 42, (FIG. 1) the two hooks being exposed on the outside of the pull cord outlets 13, 23. Owing to a certain pre-tensioned force bestowed upon the pull cords because the use in the length of each pull cord 4 is slightly shorter than the actually winding free length, the two spring hooks 42 are usually bestowed upon with a force of pulling back toward the inside of the end housings H1 and H2 thereby maintaining in a position of closely pressing against the outer sides of the pull cord outlets 13, 23. The grip belt 5 (FIG. 1) is releasably hooked on the two spring hooks 42 by belt rings 51 at the two ends thereof. This grip belt 5 described herein is not formed of a continuous strip of belt, but uses, as shown in FIG. 4, two strips of belts 5*a*, 5*b* fixed by sewing respectively to a belt ring 51 after having each bent in half at the middle. Since each belt 5*a*, 5*b* is bent in half on the middle to form two shorter belts, these shorter belts are provided on the same side respectively by sewing with, for instance, a hook tape 52 and a loop tape 53 of Velcro tape and form, as shown in FIG. 4(A), a strip of multi-tier grip belt 5 by overlapping over each other and fastening of the adhesive tapes 52, 53 of one belt 5*a* with the adhesive tapes 53, 52 of the other belt 5*b*. The design of the belt 5 is such that when not in use, not only is the entire grip belt 5 that can be removed out from the spring hooks 42 as shown in FIG. 4(A), but it is also possible to disintegrate the grip belt to form two belts 5*a*, 5*b* and with which to form, for instance, belt loops, as shown in FIG. 4(B)by adhering together the adhesive tapes 52, 53 in each belt for a multiple use. This will be described later.

FIGS. 5 and 6 show another embodiment of the multi-function pull bar of the present invention. The present embodiment differs from the above embodiment only in that on the pull bar 10 of the above described embodiment a removable sleeve cover 6 is additionally provided in order to increase and widen its uses. This sleeve cover 6 is formed as a pillow-like covering body with the upper side forming an even surface 61 and the lower side open. On the middle inner side of the upper side of this sleeve cover 6 there is arranged along the axial direction a row of at least two C-shaped fastening rings 62 with openings facing downwardly. These fastening rings 62 can be appropriately engaged to fasten upon the shank portion of the pull bar 10 having a sleeve tube 22. Because the sleeve cover 6 is formed by plastic making and the C-shaped fastening rings 62 are formed into semicircles slightly larger than the sleeve tube 22, therefore, when the rings have fastened together the pull bar 10 will not escape out. However, if some external force is applied to forcibly pull the bar 10 out from the open parts of the fastening rings 62, the openings of these fastening rings 62 will extend elastically thereby permitting an easy removal of the pull bar 10.

Furthermore, after the sleeve cover 6 has covered over the pull bar 10, the bottom of the sleeve cover 6 and the bottom of the end housings HI, H2 of the pull bar 10 are all on the same plane and can thus cover on any firm and hard surfaces of the floor. It is also possible for the fastening rings 62 if these rings are connected together as a single body to form a longer single fastening ring (not shown). Again, the said sleeve cover 6 uses a length shorter than the pull bar 10 so that the outer end portions of the two end housings H1, H2 are exposed in order to avoid covering on the pull cord spring hooks 42. However, it is equally possible if, the sleeve cover 6 is used in the same length as the pull bar 10, and in this condition, on the two ends of the upper side of the sleeve cover 6, an opening must be formed respectively for pulling the spring hooks 42 out. In the above described embodiment, the sleeve cover 6 is formed into a pillow shape in section, however, it may also be , formed in a trapezoidal shape in section as shown by dotted line in FIG. 6 and even in any other appropriate shapes.

In the following, it will now be described of the conditions on use in a variety of exercise of the pull bar of the present invention in conjunction with FIGS. 7(A) through 7(G). In FIG. 7, (A) shows that the pull bar 10 having the grip belt 5 removed can be used for chest expanding; (B) illustrates the use of the grip belt together with the pull bar for performing exercise of the chest muscles and arm strength; (C) illustrates uses for leg exercises; (D) illustrates uses for exercises of the neck portion; (E) illustrates uses for exercises of the arm strength and shoulder muscles; (F) shows that the pull bar after having been covered on with a sleeve cower 6 can be used as a pillow to lie down to practice arm strength exercise; and (G) illustrates that a person can sit on the sleeve cover 6 and practice arm strength exercise. Although it is not shown in the drawings, the pull bar 10 may be hanged by the shank portion 2 or the grip belt 5 thereof from a suitable hook on the wall, and two persons in standing or sitting may now pull the cord and do the exercise. In the foregoing, a few application examples only are disclosed, however, there are many more variations which can not be cited individually and are dependent on necessity of the individual person and on the application.

As described in the above, the present invention provides a multi-function pull bar which is simple in construction and has a low cost, and having the entire body formed in a rod shape to be light and portable and easy to carry and for storage, the pull bar having a multi-function for use in room body developing exercises.

While several preferred embodiments of the present invention have been shown and described, it will be appreciated by those skilled in the art that modifications and changes, for instance, to change the pull bar into a square tube; at the fixed end of the pull cord inside the pull rod to connect with a screw spring to increase the elasticity force; to substitute a non-flexible tubular grip rod 100, as seen in FIG, 9 or two separate rigid handles for the grip belt; to form the outer end of the end housing into a loop handle, may be made, without departing from the spirit and scope of the invention as defined in the appended claims.

I claim:

1. A multi-function pull bar, comprising:

a main bar body having an extensible dual sleeve tube structure, the main bar body including:

an inner tube having, at one end thereof, a first end housing having a hollow interior and a pull cord outlet on a surface thereof; and an outer tube slidably fitted to a tube portion of the inner tube and having, at one end thereof, a second end housing having the same construction as the first end housing, the first end housing and the second end housing being disposed at opposite ends of the main bar body; and a pull cord device including:

first and second pulley assemblies rotatably arranged in an interior of the first and second end housings, respectively, the first and second pulley assemblies including first and second pulleys, respectively;

first and second extensible pull cords of equal length, first ends of the first and second pull cords being attached to the first and second pulleys, respectively, and second ends of the first and second pull cords leading to an outside of the first and second end housings through the pull cord outlets in the first and second end housings, respectively, after the first and second pull cords pass through the inner tube, over the second and first pulleys, respectively, return through the inner tube, and wind over the first and second pulleys, respectively; and two spring hook devices connected respectively to the second ends of the first and second pull cords.

2. The multi-function pull bar of claim 1, wherein the spring hook devices at the second ends of the pull cord device are removably attached to a flexible grip belt extending between the two spring hook devices.

3. The multi-function pull bar of claim 1, wherein the spring hook devices at the second ends of the pull cord device are removably attached to a rigid tubular rod extending between the two spring hook devices.

4. The multi-function pull bar of claim 2, wherein the grip belt is provided at each of its two ends with a continuous strip having a belt ring.

5. The multi-function pull bar of claim 2, wherein the grip belt is formed of two strips of belt, each strip of belt being bent in half at a middle thereof to define a bent end and a portion defined by two free ends of the strip of belt and being connected at the bent end thereof to a belt ring, the portion defined by the two free ends of the strip of belt having means for joining the two free ends of the strip of belt to each other to form a loop belt and for joining the two free ends of the strip of belt to the two free ends of the other strip of belt to form a long strip of grip belt.

6. The multi-function pull bar of claim 1, wherein the main bar body is covered with a removable sleeve cover, the sleeve cover having an upper side, a lower side opening and at least one fastening device located on the inner side of the upper side to be fastened to the main bar body.

* * * * *